US007883663B2

(12) United States Patent
Fukaya et al.

(10) Patent No.: US 7,883,663 B2
(45) Date of Patent: Feb. 8, 2011

(54) LOW CHROMIUM STAINLESS STEEL SUPERIOR IN CORROSION RESISTANCE OF MULTIPASS WELDED HEAT AFFECTED ZONES AND ITS METHOD OF PRODUCTION

(75) Inventors: Masuhiro Fukaya, Tokyo (JP); Akihiko Takahashi, Tokyo (JP); Shinichi Teraoka, Tokyo (JP); Shunji Sakamoto, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 0 days.

(21) Appl. No.: 12/084,182

(22) PCT Filed: Jul. 3, 2007

(86) PCT No.: PCT/JP2007/063622

§ 371 (c)(1),
(2), (4) Date: Apr. 25, 2008

(87) PCT Pub. No.: WO2008/004684

PCT Pub. Date: Jan. 10, 2008

(65) Prior Publication Data

US 2009/0098009 A1 Apr. 16, 2009

(30) Foreign Application Priority Data

Jul. 4, 2006 (JP) ..... 2006-184025
Jun. 7, 2007 (JP) ..... 2007-151263
Jun. 27, 2007 (JP) ..... 2007-168307

(51) Int. Cl.
*C22C 38/28* (2006.01)
*C22C 38/18* (2006.01)
*C22C 38/00* (2006.01)

(52) U.S. Cl. ..... 420/68; 420/60; 420/70

(58) Field of Classification Search ..... 720/60, 720/68, 70; *C22C 38/00*
See application file for complete search history.

(56) References Cited

FOREIGN PATENT DOCUMENTS

JP 51-13463 4/1976

(Continued)

OTHER PUBLICATIONS

Ikawa et al, "Study on Behaviour of Caribides and Knife Line Attack Phenomenon in Stabilized Austenitic Stainless Steels (Report 1)", Journal of the JWS vol. 44, 1975, No. 8, p. 679.

*Primary Examiner*—Jessica L Ward
*Assistant Examiner*—Alexander Polyansky
(74) *Attorney, Agent, or Firm*—Kenyon & Kenyon LLP

(57) ABSTRACT

The present invention provides optimal low chromium stainless steel preventing the deterioration in corrosion resistance at the weld zone in the case of multipass welding, superior in grain boundary corrosion resistance of the weld zone even in a harsh corrosive environment, simultaneously free from preferential corrosion at the heat affected zones near weld fusion lines, and further superior in manufacturability, that is, low chromium stainless steel containing, by mass %, C: 0.03% or less, N: 0.004 to 0.02%, Si: 0.2 to 1%, Mn: over 1.5 to 2.5%, P: 0.04% or less, S: 0.03% or less, Cr: 10 to 15%, Ni: 0.2 to 3.0%, and Al: 0.005 to 0.1%, further containing Ti: 4×(C %+N %) to 0.35%, and having a balance of Fe and unavoidable impurities, having a γp(%) expressed by a predetermined formula satisfying 80 or more, and satisfying Ti %×N %<0.004 as well.

5 Claims, 4 Drawing Sheets

FOREIGN PATENT DOCUMENTS

| | | | |
|---|---|---|---|
| JP | 58-174554 | | 10/1983 |
| JP | 8-199309 | A | 8/1996 |
| JP | 2002-053938 | | 2/2002 |
| JP | 2002-167653 | * | 6/2002 |
| JP | 2002-167653 | A | 6/2002 |
| JP | 2002-327251 | | 11/2002 |
| JP | 2002-327251 | A | 11/2002 |
| JP | 3491625 | | 11/2003 |

* cited by examiner

LOW CHROMIUM STAINLESS STEEL SUPERIOR IN CORROSION RESISTANCE OF MULTIPASS WELDED HEAT AFFECTED ZONES AND ITS METHOD OF PRODUCTION

TECHNICAL FIELD

The present invention relates to low chromium stainless steel superior in corrosion resistance of weld zones improving the grain boundary corrosion resistance at the heat affected zones near weld zones in the case of multipass welding, avoiding preferential corrosion occurring at parts adjoining welds near the fusion lines, and able to be used as structural steel etc. for applications of harsh corrosive environments over long periods of time.

BACKGROUND ART

Chromium stainless steel with a low chromium content and a low nickel content is extremely advantageous cost-wise compared with austenitic stainless steel such as SUS304 steel, so is suitable for applications of use in large quantities such as structural steels. Such low chromium stainless steel has a ferritic structure or martensitic structure corresponding to the composition of ingredients. In general, ferritic or martensitic stainless steel is inferior in low temperature toughness or corrosion resistance of weld zones. For example, in the case of martensitic stainless steel such as SUS410, the C content is a high one of 0.1 mass % or so, so the steel is inferior in weld zone toughness or weld zone workability and, in addition, preheating is required at the time of welding and the welding work efficiency is inferior as well, so problems remained in application to materials requiring welding.

As a means for preventing such deterioration of characteristics of the weld zones, the method, such as described in Japanese Patent Publication (B2) No. 51-13463 and Japanese Patent Publication (B2) No. 61-23259, of using the martensitic structure formed at the weld zones to prevent a drop in the corrosion resistance and low temperature toughness has been disclosed. Japanese Patent Publication (B2) No. 51-13463 proposes the method of including Cr: 10 to 18%, Ni: 0.1 to 3.4%, Si: 1.0% or less, and Mn: 4.0% or less and further reducing C to 0.030% or less and N to 0.020% or less in the steel ingredients and forming a massive martensitic structure at the weld heat affected zones. Due to this, martensitic stainless steel for welded structures improved in performance of the weld zones is provided.

Such low chromium stainless steel using martensitic transformation in the weld zones is actually being used as beams for marine containers. Up until now, there has never been any example where the corrosion resistance or low temperature toughness at the weld zones became a problem. However, in the case of use under a harsh corrosive environment (where the steel material is wet for a long time, the chloride concentration is high, a high temperature, a low pH, etc.), it has been revealed that the corrosion resistance at the weld zones is insufficient. For example, in the case of use at the beds of railroad cars carrying coal or iron ore, it has been reported that grain boundary corrosion occurs at the weld heat affected zones.

As the method of improving the corrosion resistance of weld heat affected zones or the weld zone toughness of low chromium stainless steel, the above-mentioned higher purity and, further, in addition to this the addition of elements for fixing carbon or nitrogen as carbides or nitrides are effective, so various steels produced by this means have been disclosed. For example, Japanese Patent Publication (A) No. 2002-327251 discloses the addition of suitable quantities of the carbon and nitrogen stabilizing elements Nb and Ti so as to prevent the deterioration of the grain boundary corrosion resistance of the weld zones of low chromium stainless steel using martensitic transformation and thereby obtaining low chromium stainless steel superior in low temperature toughness. Japanese Patent No. 3491625 similarly discloses an Fe—Cr alloy obtained by adding the carbonitride-forming elements Ti, Nb, Ta, and Zr and thereby improved in weld zone corrosion resistance. However, this patent requires the inclusion of Co, V, and W and has as its object the improvement of the resistance to initial rust formation.

With the above as background, in recent years, in environments of use for railroad car beds for coal or iron ore mined inland and transported by rail to the shore etc., as a measure against grain boundary corrosion of the weld heat affected zones, there is the example of use of low chromium stainless steel to which Ti is added in the same way as the disclosures of Japanese Patent Publication (A) No. 2002-327251 and Japanese Patent No. 3491625.

However, in this example, the weld heat affected zones are improved in grain boundary corrosion resistance, but the inventors newly discovered that there is a problem with occurrence of preferential corrosion at the weld zones and the heat affected zones most adjoining them, that is, near the locations along the interface with the massive martensitic structure (fusion lines). This phenomenon, as disclosed in the *Journal of the JWS*, vol. 44, 1975, no. 8, p. 679, is similar to the phenomenon called "knife line attack" seen in weld zones of SUS321 or SUS347 stable austenitic stainless steel. Corrosion proceeds preferentially at the interfaces (fusion lines) between the weld zones and heat affected zones and the corroded regions expand, so this is a problem which should be improved on.

Knife line attack is caused during the welding of stainless steel fixing C by TiC or NbC by the TiC or NbC becoming solid solute in the region where the heat history is raised to about 1200° C. or more and then the Cr carbides precipitating at the crystal grain boundaries and the corrosion resistance dropping when passing through the sensitization temperature region in the subsequent cooling process. However, in the case of low chromium stainless steel, for what sort of reasons preferential corrosion occurs has not been sufficiently studied. Countermeasures have not been devised either.

Further, the above-mentioned low chromium stainless steel to which C- and N-fixing elements are added is of a system of ingredients improving the grain boundary corrosion resistance of the weld zones, but the corrosion resistance of the heat affected zones after several welding operations can hardly be said to be sufficient. It has been reported that corrosion sometimes occurs at the weld heat affected zones. From the viewpoints of increase the freedom of design of welded structures and of improving the ease of weld repair, a low chromium stainless steel enabling multipass welding which is superior in corrosion resistance of the heat affected zones even after multipass welding is being awaited.

On the other hand, in the production of low chromium stainless steel, it is known that edge cracking easily occurs at the time of hot rolling. This is believed due to the stability of the austenitic phase and the phase of δ-ferrite in the hot working temperature region being directly affected by the change in balance of the contained elements. Accordingly, there are problems to be solved from the viewpoint of the optimization of the production process as well. Improvement has been desired.

Further, in the case of use for the beds of railroad cars carrying coal or iron ore, increasing the load capacity so as to improve the transport efficiency and reducing the weight so as to reduce the fuel consumption etc. have been earnestly desired. The gross weight of railroad cars is fixed, so to raise the load capacity, it is essential to make the stainless steel plate thinner. To realize this, increased strength of low chromium stainless steel plate is essential, but low chromium stainless steel plate superior in strength-ductility balance considering workability as well has not yet been developed. Its appearance has been awaited.

DISCLOSURE OF THE INVENTION

The present invention has as its first object the provision of optimal low chromium stainless steel preventing deterioration of the corrosion resistance in the weld zones in the case of multipass welding of low chromium stainless steel using martensitic transformation, superior in grain boundary corrosion resistance of multipass weld zones even in harsh corrosive environments such as where coal or iron ore railroad cars are used, simultaneously free from preferential corrosion occurring near weld zone fusion lines, and superior in manufacturability. It has as its second object the provision of high strength low chromium stainless steel superior in the strength-ductility balance according to need.

The inventors engaged in in-depth studies to achieve the above object and as a result discovered that to prevent grain boundary corrosion at the weld zones and their vicinities in the case of multipass welding, it is possible to add Ti and Nb stabilizing the carbon and nitrogen causing the occurrence of grain boundary corrosion, but on the other hand the addition of Ti and Nb has no effect in the prevention of preferential corrosion near the weld zone fusion lines.

Therefore, the inventors engaged in studies to prevent preferential corrosion of the heat affected zones adjoining the weld zones and as a result discovered that the heat affected zones where the massive martensite is formed adjoining the weld zones are exposed to extremely high temperatures, so depending on the welding method, scale is thickly formed at just these locations, the concentration of Cr directly under the scale drops, a so-called Cr-depleted layer is formed, and as a result preferential corrosion similar to knife line attack as a phenomenon occurs. Further, the inventors found that if the content of Ti having an effect on grain boundary corrosion resistance of the multipass weld heat affected zones increases, it becomes a cause of surface defects due to the precipitation of TiN, so it is necessary to control the product of the concentrations of Ti and N to 0.004 or less. Further, the inventors engaged in studies to improve the corrosion resistance of the weld heat affected zones and, further, to prevent the drop in weld zone toughness and as a result discovered that the object could be achieved by designing the ingredients to satisfy the following formula (A) describing the austenite stability and achieving suitable phase stability.

$$\gamma p(\%)=420\times C\,\%+470\times N\,\%+23\times Ni\,\%+9\times Cu\,\%+7\times Mn\,\%-11.5\times Cr\,\%-11.5\times Si\,\%-12\times Mo\,\%-23\times V\,\%-47\times Nb\,\%-49\times Ti\,\%-52\times Al\,\%+189\geqq 80 \quad (A)$$

γp (gamma potential) is an indicator for evaluating the stability of austenite. Simultaneously, it is an indicator expressing the ease of formation of martensite.

Further, the inventors discovered that in the production of stainless steel designed in ingredients as above, when controlling the heating temperature in the hot rolling process of cast slabs to a temperature where the austenite single phase region or amount of δ-ferrite exceeds 50%, it is possible to produce low chromium stainless steel free from edge cracking.

Further, the inventors engaged in in-depth studies to achieve the above second object and as a result discovered that in low chromium ferritic stainless steel, a sufficiently increased strength cannot be realized with the annealed ferritic structure as is.

Therefore, the inventors engaged in studies to increase the strength of low chromium ferritic stainless steel, whereupon they discovered that in producing stainless steel designed in ingredients to improve the corrosion resistance of the heat affected zones adjoining the weld zones, by suitably selecting the heat treatment temperature and soaking time in the heat treatment process of hot rolled plate, it is possible to suitably adjust the metal structure to a two-phase structure of ferrite and martensite in the tempering softening heat treatment process of martensitic structure hot rolled plate and thereby possible to produce high strength chromium stainless steel superior in strength-ductility balance. In particular, this is effective and practical for the case of ingredients suitably containing Nb and Ni and raising the tempering softening resistance. The heat treatment conditions are practically speaking for example a heat treatment temperature of 600 to 800° C. and a soaking time of 2 to 30 hours. By setting a suitable temperature, the desired metal structure can be obtained.

The present invention was completed based on this discovery and has as its gist the following:

(1) Low chromium stainless steel superior in grain boundary corrosion resistance of multipass weld heat affected zones and preferential corrosion resistance near weld zone fusion lines characterized by containing, by mass %, C: 0.03% or less, N: 0.004 to 0.02%, Si: 0.2 to 1%, Mn: over 1.5 to 2.5%, P: 0.04% or less, S: 0.03% or less, Cr: 10 to 15%, Ni: 0.2 to 3.0%, and Al: 0.005 to 0.1%, further containing Ti: 4×(C %+N %) to 0.35%, and having a balance of Fe and unavoidable impurities, and having contents of the elements satisfying the following formula (A) and formula (B):

$$\gamma p(\%)=420\times C\,\%+470\times N\,\%+23\times Ni\,\%+9\times Cu\,\%+7\times Mn\,\%-11.5\times Cr\,\%-11.5\times Si\,\%-12\times Mo\,\%-23\times V\,\%-47\times Nb\,\%-49\times Ti\,\%-52\times Al\,\%+189\geqq 80 \quad (A)$$

$$Ti\,\%\times N\,\%<0.004 \quad (B)$$

(2) Low chromium stainless steel superior in grain boundary corrosion resistance of multipass weld heat affected zones and preferential corrosion resistance near weld zone fusion lines as set forth in (1) characterized by further containing, by mass %, one or both of Mo: 0.05 to 3% and Cu: 0.05 to 3%.

(3) Low chromium stainless steel superior in grain boundary corrosion resistance of multipass weld heat affected zones and preferential corrosion resistance near weld zone fusion lines as set forth in (1) or (2) characterized by further containing, by mass %, one or both of Nb: 0.01 to 0.5% and V: 0.01 to 0.5%.

(4) Low chromium stainless steel superior in strength-ductility balance and superior in grain boundary corrosion resistance of multipass weld heat affected zones and preferential corrosion resistance near weld zone fusion lines comprising stainless steel comprising ingredients as set forth in any one of (1) to (3), characterized in that a metal structure is a two-phase structure of a ferritic phase and martensitic phase and in that a spread B of half width defined by the following formula (C) of a Kα{110} diffraction line in X-ray diffraction is 0.1 to 1.0.

$$B=(W-Wo)/Wo \quad (C)$$

Wo: Half width without internal strain (deg)

W: Half width (deg)

(5) A method of production of low chromium stainless steel superior in grain boundary corrosion resistance of multipass weld heat affected zones and preferential corrosion resistance near weld zone fusion lines characterized in that a heating temperature in a hot rolling process of a cast slab comprising ingredients as set forth in any one of (1) to (3) is less than an upper limit temperature $Ac_4$ of an austenite single phase determined from the ingredients of the cast slab or, when heating over $Ac_4$, is made a temperature by which an amount of δ-ferrite in the austenitic phase becomes more than 50%.

BEST MODE FOR CARRYING OUT THE INVENTION

Figure 1:
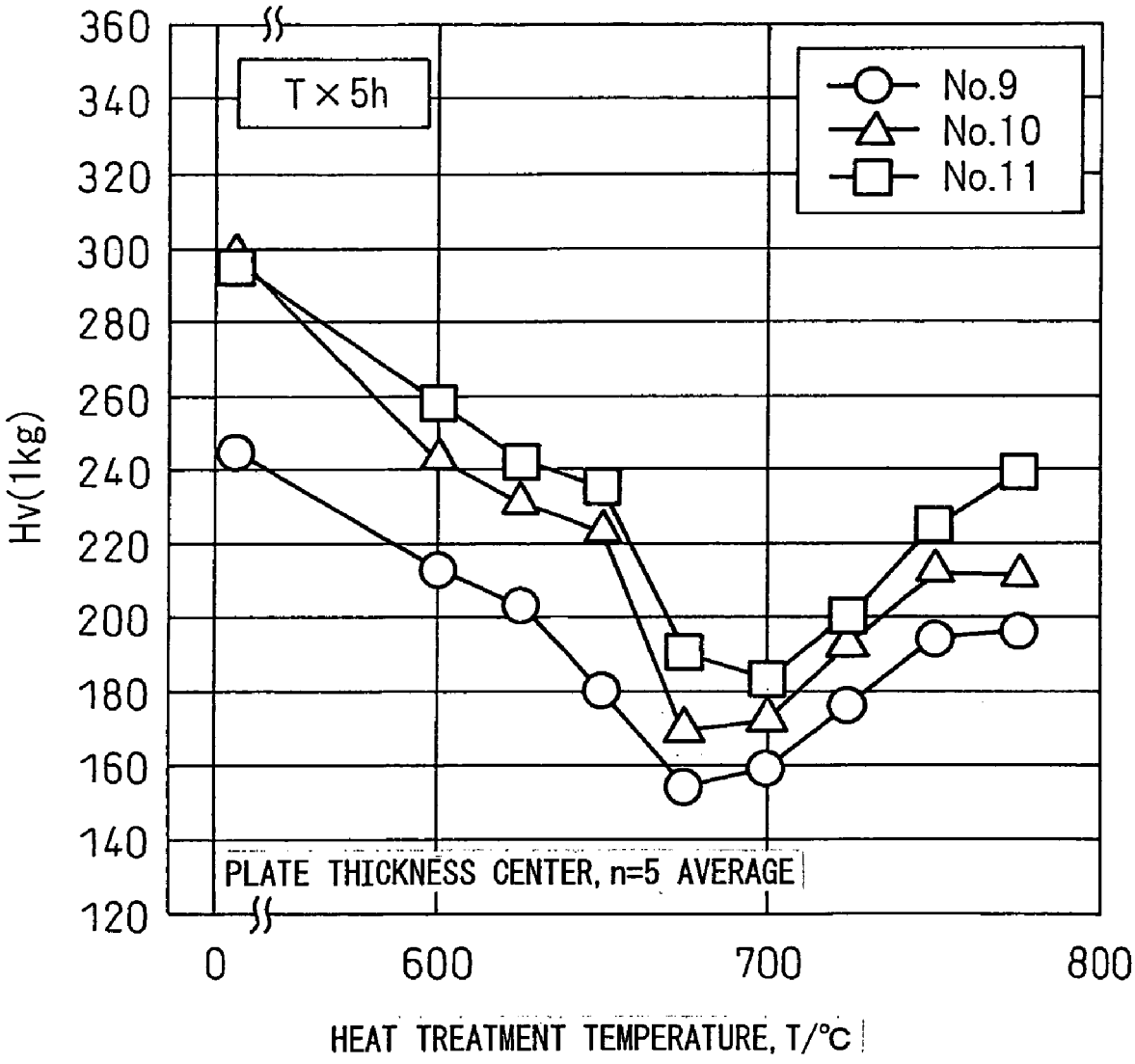
FIG. 1 is a view showing an example of the relationship between the annealing temperature and hardness.

The present invention will be explained in further detail. First, the reasons for limitation of the ingredients will be explained.

C lowers the toughness of the martensitic structure of the weld zone and becomes a cause of a drop in the grain boundary corrosion resistance, so the content was made 0.03 mass % or less.

N precipitates as nitrides and forms Cr-deficient phases, so causes deterioration of the grain boundary corrosion resistance, therefore the upper limit of the content was made 0.02 mass % or less. However, in the range of ingredients of the present invention, excessive reduction of N not only causes an increase in the refining load, but also results in softening, so the quality desired as a structural material can no longer be obtained, therefore the lower limit of the content was made 0.004 mass %.

Si is an element usually used as a deoxidizing material, but if the content is less 0.2 mass %, a sufficient deoxidizing effect is not obtained. Further, it is sometimes added intentionally for the purpose of improving the oxidation resistance, but if the content exceeds 1 mass %, it causes deterioration of the manufacturability of the material, so the content was limited to 0.2 to 1 mass %.

Mn is an element stabilizing the austenitic phase (γ-phase) and makes the weld heat affected zone structure a martensitic structure so effectively contributes to improvement of the weld zone toughness. Further, Mn, like Si, is useful as a deoxidizing agent, so was included in a range of over 1.5 mass %. However, if excessively added, it forms sulfide-based inclusions causing deterioration of the corrosion resistance of the steel material, so the content was limited to 2.5 mass % or less, more preferably, 2.0 mass % or less.

P is an element easily precipitating at the grain boundaries. It not only causes deterioration of the hot workability or shapeability and toughness, but is also harmful to the corrosion resistance. In particular, this effect becomes remarkable if the content exceeds 0.04 mass %, so the P content was kept down to 0.04 mass % or less, more preferably 0.025% or less.

S is an element forming sulfide-based inclusions and causing deterioration of the corrosion resistance of the steel material. The upper limit of the content must be made 0.03 mass %. The smaller the content of S, the better the corrosion resistance, but this causes an increase in the desulfurization load for reducing the amount of S, so the lower limit is preferably made 0.003 mass %.

Cr is an element effective for improvement of the corrosion resistance, but if less than 10 mass %, securing a sufficient corrosion resistance is difficult. Further, Cr is an element stabilizing the ferritic phase (α-phase). Addition over 15 mass % not only invites a drop in the workability, but also lowers the stability of the austenitic phase (γ-phase), makes it impossible to secure a sufficient amount of martensitic phase at the time of welding, and invites a drop in the strength and toughness of the weld zone. Therefore, in the present invention, Cr was included in a range of 10 mass % to 15 mass %. Note that for obtaining rust resistance or workability and weldability, the particularly preferable range is 11.0 to 13.0 mass %. Furthermore, for not only the grain boundary corrosion resistance of the multipass weld heat affected zones, but also for preventing preferential corrosion near the weld zone fusion lines, the content is preferably made 11.4 mass % or more.

Ni is an element essential for improving the corrosion resistance and for forming martensite at the weld zones to improve the weld zone toughness. The content has to be at least 0.2 mass % or more. However, if the content exceeds 3.0 mass %, the amount of formation of martensite at the weld zones remarkably increases, so the content was made 0.2 to 3.0 mass %. Further, Ni has the action of raising the tempering softening resistance of the martensitic structure of hot rolled plate, so when producing a high strength material superior in strength-ductility balance, it is possible to broaden the scope of application at the time of tempering and annealing of hot rolled plate.

Ti is an element essential for preventing grain boundary corrosion resistance at the weld zones. The content of Ti has to be a content of at least four times the sum of the contents of C and N, but on the other hand even if added over 0.35 mass %, the effect of improvement of the grain boundary corrosion resistance becomes saturated and, as explained later, the formation of cluster-shaped inclusions causes the formation of surface defects at the time of hot rolling, a drop in workability, and deterioration of other properties. Therefore, from the viewpoint of the corrosion resistance, the lower limit of the content of Ti was made 4×(C mass %+N mass %), while from the viewpoint of the surface properties, the upper limit was made 0.35 mass %.

Al is an added ingredient effective as a deoxidizing agent, but if contained in a large amount, the surface quality of the steel material deteriorates and the weldability also becomes poorer, so the content was made 0.005 to 0.1 mass % in range, preferably, 0.005 to 0.03 mass %.

Further, in addition to the ranges of concentrations of ingredients above, the concentrations of the ingredients are prescribed to satisfy the following formula (A). By this prescription, it is possible to obtain low chromium stainless steel superior in weld zone toughness and grain boundary corrosion.

By mass %, $$\gamma p(\%)=420\times C\ \%+470\times N\ \%+23\times Ni\ \%+9\times Cu\ \%+7\times Mn\ \%-11.5\times Cr\ \%-11.5\times Si\ \%-12\times Mo\ \%-23\times V\ \%-47\times Nb\ \%-49\times Ti\ \%-52\times Al\ \%+189\geqq 80 \quad (A)$$

The γp of formula (A) is an indicator showing the stability of austenite in stainless steel and simultaneously is an indicator expressing an ease of formation of martensite. If γp is 80% or more, when the weld heat affected zones cool, they pass through a high temperature austenite single phase region and completely transform to form a sufficient martensitic structure at the weld heat affected zones. On the other hand, if less than 80%, the austenite becomes unstable and the martensitic phase is insufficiently formed. Simultaneously, during the hot rolling, to cause complete transformation through the γ-single phase and obtain a fine grained structure as hot rolled, it is necessary to satisfy the formula (A).

Further, a finer crystal grain size of the ferrite is also advantageous for improvement of the grain boundary corrosion resistance due to the increase in the grain boundary area and improvement of the low temperature toughness. Therefore, the average grain size of the ferrite is preferably made #6 or more in terms of the ferrite grain numbers based on JIS G 0522. Note that the ferrite grain numbers indicate sizes in the final products, but the low chromium stainless steel of the present invention is required to be low cost as a structural material, so the final product is solely a hot rolled annealed material.

Further, in addition to the above ranges of concentrations of ingredients and the above formula (A), the concentrations of ingredients are prescribed so as to satisfy the following formula (B). Due to this provision, it is possible to prevent the occurrence of surface defects at the hot rolled plate.

If the formula (B) is not satisfied and the contents of Ti and N are high, when the molten steel solidifies, large numbers of coarse TiN will precipitate at the liquid-phase line temperature and will cause surface defects at the time of hot rolling. As explained above, the final product is a hot rolled annealed material, so is often descaled and used as pickled skin, so the ingredients must be restricted from the viewpoint of prevention of surface defects as well.

$$Ti\ \%\times N\ \%<0.004 \quad (B)$$

The above explained low chromium stainless steel is superior in weld zone toughness and grain boundary corrosion resistance, but to further improve the corrosion resistance in a low pH solution, addition of Mo or Cu into the steel would work effectively. In particular, addition of Cu would be effective for the low pH dilute sulfuric acid environment by exudate from coal in the case of carrying coal.

Mo and Cu both have to be added in amounts of at least 0.05 mass % in order to improve the corrosion resistance, but if Mo is added over 3 mass % or Cu is added over 3 mass %, the effect of improvement of the corrosion resistance becomes saturated. This becomes a cause of deterioration of the workability etc. Therefore, the upper limit of Mo was made 3 mass % and the upper limit of Cu was made 3 mass %. Preferably, Mo and Cu are both 0.1 to 1.5 mass %. Further, Cu is an austenite-stabilizing element second to only C, N, and Ni, so is an effective element for controlling the phase stability calculated from γp of formula (A). Further, Cu is also a solution strengthening element, so is an element effective when increasing the strength.

Nb and V are carbonitride-forming elements and can be selectively added. To fix the C and N, with Nb, a content of 0.01 mass % becomes necessary. Even if added over 0.5 mass %, the effect of improvement of the grain boundary corrosion resistance becomes saturated. This becomes a cause of deterioration of the workability and other characteristics. Therefore, Nb was made 0.01 to 0.5 mass % in range, preferably 0.03 to 0.3 mass %. V, for similar reasons, was made 0.01 to 0.5 mass % in range, preferably 0.03 to 0.3 mass %. Further, Nb has the action of raising the tempering softening resistance of the martensitic structure of hot rolled plate, so when producing a high strength material superior in strength-ductility balance, it is possible to broaden the range of the annealing conditions at the temper annealing of the hot rolled plate.

The high strength material adjusted in strength-ductility balance has a yield strength of 450 MPa or more and an elongation of 15% or more. Having a yield strength of 450 MPa and an elongation of 20% or more is preferable. More preferable is a yield strength of 500 MPa or more and an elongation of 20% or more.

The metal structure of high strength low chromium stainless steel superior in strength-ductility balance is not a completely annealed ferrite single phase structure, but is controlled to a two-phase structure of a ferritic phase and a martensitic phase. This is a metal structure in the temper softening process of the martensitic phase structure of hot rolled plate and is provided with the high strength of the martensitic phase and ductility due to the tempering. Further, the above metal structure may also be a metal structure where a precipitated austenitic phase (reverse transformed γ-phase) is combined with a martensitic phase transformed to at the time of cooling.

There is a correspondence between the extent of progression of softening of martensite due to the above tempering and the strength and ductility, so control of the percentages of the martensitic phase and ferritic phase is important in designing the strength, ductility, and other material properties. However, differentiating and finding the volume percentages of the ferritic phase and martensitic phase in a metal structure is generally difficult. The two phases both have the same crystal structures, so the diffraction angles in X-ray diffraction are almost the same and differentiation is difficult. Further, both phases are ferromagnetic, so differentiation by the presence/absence of magnetism is also difficult.

Therefore, in the present invention, as a method enabling measurement of the extent of recovery of dislocations in the tempering process of a martensitic structure, that is, the extent of recovery of disturbances in the crystal structure, the inventors decided to use the spread B of half width, defined by the following formula (C), of the Kα{110} diffraction line in the X-ray diffraction profile. In the method, the Kα1 and Kα2 peaks are separated and the half width of the Kα1 line is measured to find B.

$$B=(W-Wo)/Wo \quad (C)$$

Wo: Half width without internal strain (deg)

W: Half width (deg)

In the present invention, Cu was used as the X-ray source, but another X-ray source is also possible. Further, the value of 11 mass % Cr ferritic stainless steel (Steel Material No. 1 of Table 1 of later explained examples) (Wo=0.089 deg) was used to evaluate B.

This technique is a general technique for evaluation of the tempering behavior of steel such as disclosed in the Iron and Steel Institute of Japan, Material and Structure Characteristics Subcommittee, Stainless Steel Shapeability and Utilization Technology Forum, "Technology for Increasing Strength of and Utilizing Stainless Steel", Sep. 29, 1998, p. 49.

The half width corresponds to the dislocation density. "Half width" is defined as the width of the diffraction angle corresponding to a strength of ½ of the peak strength from the diffraction plane. The larger the half width, the greater the amount of strain of the material (disturbance in crystal structure). When the tempering progresses, the dislocations recover, and the amount of strain becomes smaller, the half width becomes smaller. B=0 means the annealed structure after relief of strain (in tempered structure, ferrite single phase). In the present invention, B was less than 0.1. In the martensitic structure of the steel plate as rolled, the B value is about 2.0. To control the structure in the tempering process to a two-phase structure of the martensitic phase and ferritic phase and obtain a high strength material superior in strength and ductility, the B value is 0.1 to 1.0, preferably 0.3 to 0.8. If the B value is over 1.0 to less than 2.0, the tempering does not proceed and the ductility is insufficient.

Next, a preferred method of production of low chromium stainless steel will be explained. First, the molten steel adjusted to the above preferred composition of ingredients is produced in a converter or electric furnace or other usual known furnace, then refined by the vacuum degassing process (RH process), VOD process, AOD process, or other known refining process, then cast to a slab etc. by the continuous casting method or blooming-slabbing to obtain a steel material. The steel material is then heated and processed by the hot rolling process to obtain hot rolled steel plate. At this time, the selection of the heating temperature in the hot rolling process is extremely important from the viewpoint of avoidance of edge cracking of the hot rolled plate. In the case of an austenitic stainless steel, in the phase state at the stage of hot working where the δ-ferrite is less than 50%, in particular 10 to 30%, the difference in the deformation resistances of the two phases of the austenite and δ-ferrite results in strain concentrating at the soft phase of δ-ferrite, cracking at the interface of the two phases, and susceptibility to surface cracking or in particular edge cracking or other defects, so various problems occur in the process, yield, and quality. The inventors discovered that the same is true in the hot working temperature region of low chromium stainless steel as well.

Therefore, when the heating temperature at the hot working process of the cast slab is less than the upper limit temperature $Ac_4$ of the austenite single phase determined from the ingredients of the cast slab or when selecting a temperature where the amount of the δ-ferrite in the austenitic phase becomes over 50% when heating over $Ac_4$, a good hot workability is obtained. The temperature of $Ac_4$ can be determined from the values of the ingredients of the steel material from calculations by status diagrams using a Thermo-Calc® general thermodynamic calculation system (vendor: CRC Solutions). If the heating temperature is high, the deformability rises along with an increase in the amount of δ-ferrite, but in the case of a mainly phase of δ-ferrite, if the heating temperature is too high, coarsening of the crystal grains is invited, wrinkle type defects due to the coarsened crystal grains occur at the edge parts of the hot rolled plate at the time of hot working, and problems arise in the process, yield, and quality in the same way as the edge cracking, so the heating temperature is preferably made 1300° C. or less.

Further, in the hot rolling process, it is sufficient obtain the desired thickness of hot rolled steel plate. The hot rolling conditions are not particularly limited, but making the finishing temperature of the hot rolling 800° C. to 1000° C. is preferable from the viewpoint of securing strength, workability, and ductility. Further, the coiling temperature, in the case of tempering and annealing, is 800° C. or less, preferably 650° C. to 750° C.

Note that when increasing the strength by a two-phase structure of a ferritic phase and martensitic phase in the later mentioned tempering process, it is preferable to make the finishing temperature of the hot rolling 900° C. or less and the coiling temperature 650° C. or less to build up work strain and improve the tempering softening resistance from the viewpoint of broadening the range of annealing conditions.

For materials where the structure becomes the martensitic phase and therefore hardens after the end of hot rolling, it is preferable to anneal the hot rolled plate so as to soften it by tempering of the martensitic phase. The tempering temperature is preferably as high a temperature as possible in the ferrite temperature region. The upper limit temperature of the ferrite single phase, that is, the $A_1$ transformation point, differs depending on the amount of addition of Ni etc., but in practical steel is often adjusted to about 650 to 700° C. Annealing at below this temperature is preferable. Therefore, this hot rolled plate annealing is preferably performed at an annealing temperature of 650 to 750° C. and a soaking time of 2 to 20 hours from the viewpoints of not only softening, but also improvement of the workability and securing ductility.

Note that after hot rolled plate annealing, making the cooling rate in the 600 to 750° C. temperature range a slow cooling of 50° C./h or less is preferable in terms of softening.

In accordance with need, when providing high strength low chromium stainless steel superior in strength-ductility balance, it is necessary to control the material to not a completely annealed ferritic phase structure, but to a two-phase structure of a ferritic phase and martensitic phase in the tempering softening process of the martensitic phase structure of the hot rolled plate. For this reason, the heat treatment temperature of the hot rolled plate is made 550° C. to 850° C. The soaking time is not particularly limited, but is preferably made the heat treatment time considering practicability. Therefore, preferably the soaking time is made 2 to 30 hours at the heat treatment temperature of 600 to 800° C. In the case of batch heat treatment, usually the cooling rate is controlled to 50° C./h or less. The heat treatment temperature may be $Ac_1$ or more or $Ac_1$ or less.

In the case of the $Ac_1$ or less, the metal structure must be made the metal structure in the tempering softening process of the martensitic phase and the soaking time must be made a soaking time shorter than that resulting in a completely annealed ferrite single phase structure. This heat treatment condition can be found by preparing a temperature-time map of the hot rolled plate structure for the individual composition of ingredients of the steel.

In the case of the $Ac_1$ or more, the metal structure must be made the metal structure obtained by heat treatment of $Ac_1$ or less and a metal structure where the precipitated austenitic phase (reverse transformed γ-phase) combined with the martensitic phase transformed to at the time of cooling. The soaking time in this case is not particularly limited, but is in practice 2 to 30 hours, preferably 2 to 15 hours.

Further, the steel plate after hot rolling or after hot rolling and annealing may in accordance with need be shot blasted, pickled, etc. to remove the scale and in that state optionally further polished, skin pass rolled, etc. to adjust it to the desired surface properties, then made the final plate. Further, the steel of the ingredients of the present invention may be used for various types of steel materials able to be utilized as structural steel in fields such as thick-gauge steel plate, steel shapes produced by hot rolling, and bar steel.

EXAMPLES

Example 1

Table 1 and Table 2 show invention steels and comparative steels relating to the first pending issue.

Table 1 shows the steel ingredients of the invention steels and comparative steels by mass %. Steel Material Nos. 1 to 20 are invention steels, while Steel Material Nos. 21 to 26 are comparative steels.

The vacuum melting method was used to melt cast slabs of the ingredients shown in Table 1 into 40 kg or 35 kg flat ingots. These steels were touched up on their surfaces, then the ingots were heated at 1150° C. to 1250° C. for 1 hour and processed by hot roughing comprised of multiple passes and the following finishing rolling. The end temperature of the hot rolling was 800° C. to 950° C. The hot rolled plates were air cooled, then soaked at a coiling temperature of 700° C. for 1 hour, then air cooled and coiled up for simulated heat treatment so as to obtain hot rolled plates of plate thicknesses of 4 mm. Next, to determine the annealing temperatures of the hot rolled plates, various ingredients of hot rolled steel plates were heat treated at 600° C. to 775° C. for 5 hours, then air-cooled. The temperature giving the greatest softness was made the annealing temperature.

FIG. 1 is an example showing the relationship between the heat treatment temperature and hardness. As hot rolled, the hardnesses are high, but the plates soften by heat treatment. In this example, the plates soften the most at 675 to 700° C. If using a higher temperature for heat treatment, the austenitic phases precipitate and transform to martensite at the time of cooling, so the plates conversely harden. Note that the Vicker's hardness (Hv) of the L-cross-section was measured and evaluated at the center of the plate thickness by a load of 1 kg.

Finally, the plates were shot blasted and pickled to descale them and produce hot rolled annealed plates.

Table 2 shows results of evaluation of the various properties of the invention examples and comparative examples. Case Study Nos. 1 to 20 are invention examples, while Case Study Nos. 21 to 27 are comparative examples.

The invention steels not only have superior weld zone corrosion resistance with no grain boundary corrosion at the multipass weld zones and preferential corrosion near the weld zone fusion lines, but are also superior in impact characteristics of the weld zones. Further, they are also good in strength and ductility properties and can be strikingly improved in sulfuric acid resistance by selectively added elements. Further, by adjusting the design of the ingredients of the steel materials or production conditions, it is possible to obtain steel materials free of edge cracking or surface defects of the hot rolled plates and superior in manufacturability.

Comparative Example Case Study No. 21 had a Ti content and Ti/(C+N) outside the range of the present invention, so was inferior in corrosion resistance of the weld heat affected zone. Comparative Example Case Study No. 22 had a Ti.N outside the range of the present invention, so suffered from surface defects due to hot rolling. Comparative Example Case Study No. 23 had a Ti above the upper limit of the range of the present invention, so had a Ti.N outside the range of the present invention and suffered from surface defects due to hot rolling. Comparative Example Case Study No. 24 had a γp outside the range of the present invention, so was inferior in impact characteristics of the weld heat affected zone. Comparative Example Case Study No. 25 had a Cr above the upper limit of the range of the present invention, so had a γp outside the range of the present invention and was inferior in impact characteristics of the weld heat affected zone. Further, in the present application, there is no temperature region of the γ-single phase, so the $Ac_1$ cannot be defined. Comparative Example Case Study No. 26 had a Cr below the lower limit of the range of the present invention, so was inferior in sulfuric acid resistance and weld heat affected zone corrosion resistance. Comparative Example Case Study No. 27 had a δ-amount at the hot rolling heating temperature outside the range of the present invention, so suffered from edge cracking.

Below, the methods of evaluating and testing the various properties will be explained.

The composition was analyzed by taking a test sample from each steel plate. C, S, and N were analyzed by gas analysis (N was analyzed by the method of melting the samples in an inert gas and measuring the heat conductivity and C and S were analyzed by burning in an oxygen flow and infrared absorption). Other elements were analyzed a fluorescent X-ray analysis apparatus (SHIMADZU, MXF-2100).

The presence of occurrence of edge cracking of each hot rolled plate was judged by visual observation of any cracks at the edge parts of the hot rolled plate. The absence of cracks was shown by "G" (good), the presence of cracks, but not passing through the plate from the front surface to the rear surface was shown by "F" (fair), and the presence of cracks passing through the plate from the front surface to the rear surface was shown by "P" (poor). Note that edge cracking did not occur when the hot rolling heating temperature was a lower temperature than the $AC_4$ (upper limit temperature of austenite single phase) calculated from the values of the ingredients using the Thermo-Calc® scientific and technical calculation software or, if higher, a temperature where the amount of δ-ferrite becomes over 50%.

The presence of any "crocodile skin", one type of surface defect of hot rolled plate, was judged by visual observation of such defects on the hot rolled plate. No surface defects was shown as "G" (good), while defects was shown as "P" (poor).

The 0.2% yield strength and elongation were analyzed by preparing JIS Z 2201 No. 13B test pieces from the hot rolled annealed plate and testing them by the JIS Z 2241 test method using an Instron-type tensile tester. The L-direction (parallel to rolling direction) data was measured by n=2. The "G" and "P" in the table show 0.2% yield strengths of 320 MPa or more ("G" good) and less than 320 MPa ("P" poor) and further elongations of 20% or more ("G" good) and less than 20% ("P" poor).

The sulfuric acid immersion test method is shown below. 2 mm×25 mm×25 mm corrosion test pieces were prepared from each hot rolled annealed and pickled plate. The corrosive solutions were made 0.1, 0.01, and 0.001N sulfuric acid solutions (pH=1, 2, 3). The amount of solution was made 500 ml per test piece. The test temperature was made 30° C.

Figure 2:
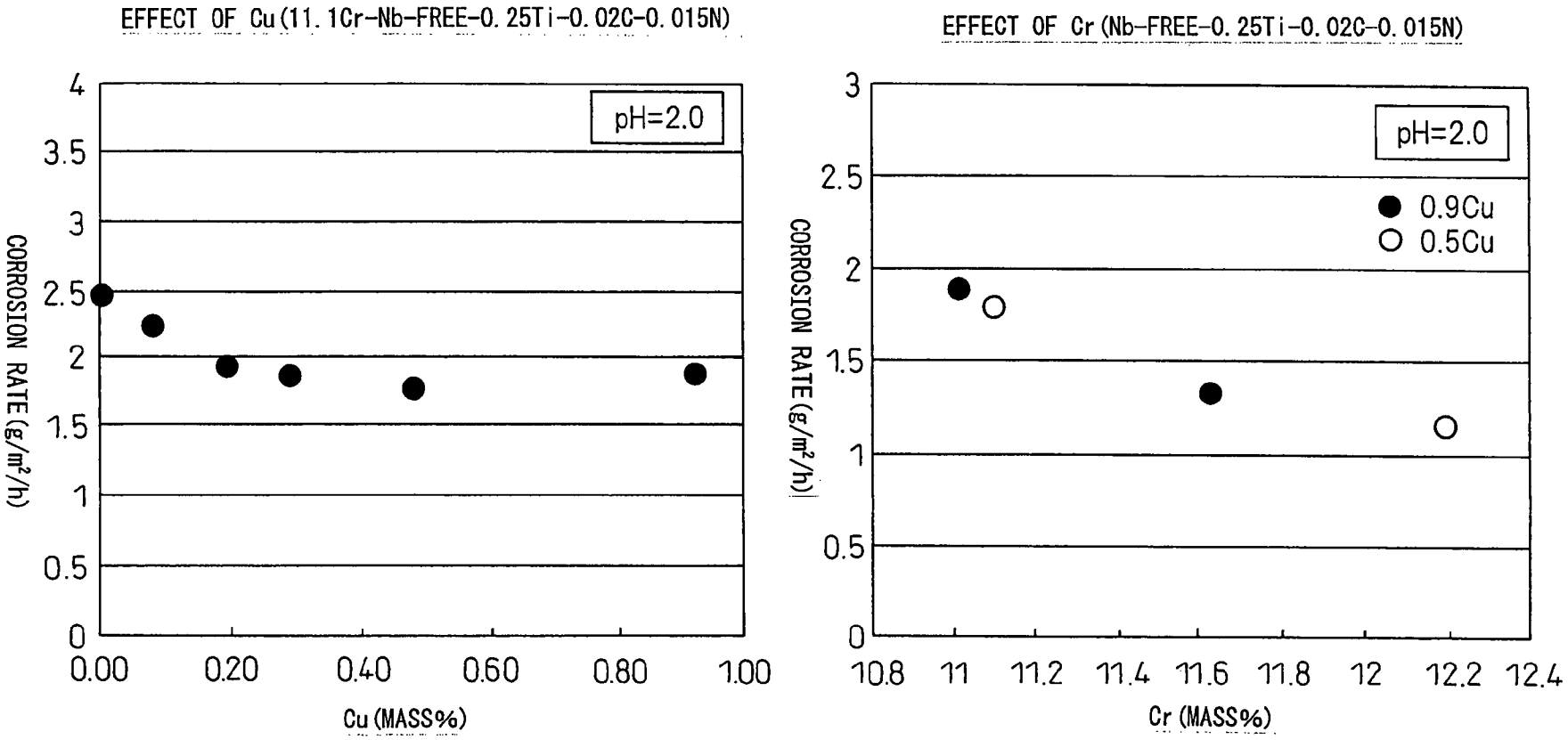
FIG. 2 gives view showing the effects of Cu and Cr on the corrosion rate in the case of a steel material of 0.25 mass % Ti and a pH=2 in results of a sulfuric acid immersion test.

As a representative example, when pH=2, a corrosion rate of 3 $g/m^2/h$ or less was shown as "G" (good), in particular when 2 $g/m^2/h$ or less as "VG" (very good), while a rate of over 3 $g/m^2/h$ was shown as "P" (poor). FIG. 2 is a view showing the effects of Cu and Cr on the corrosion rate in the results of the sulfuric acid immersion test in the case of a 0.25 mass % Ti steel material and pH=2. If adding Cu, the corrosion rate falls. If adding 0.3 to 0.5 mass %, the corrosion rate falls the most. Even if increasing the amount of Cr above this, the effect of Cu is saturated. The corrosion rate can be reduced by adding Cr as well.

The TIG welding was performed filler-free, the welding rate was 200 cm/min, the welding current was 110 A, and the seal gas was argon gas. The MIG welding was performed by the following method.

For the welding material, 309 LSi (C: 0.017%, Si: 0.74%, Mn: 1.55%, P: 0.024%, S: 0.001%, Ni: 13.68%, Cr: 23.22%) was used. The welding was performed under the conditions of a voltage of 25 to 30V, a current of 230 to 250 A, and a shield gas of 98% Ar+2% $O_2$. For the welder, a Daihen Turbo-Pulse® was used. The welding was performed passing through a 4 mm plate thickness under sufficient back bead producing conditions. In the case of a butt welded joint, with a 90° V bevel, the root face was made 2 mm (gap 0) and the input heat Q was made about 12500 J/cm, while in the case of cross welding, the welding was performed after removing the seam weld zone leaving a 1 mm thickness or so and the Q was made about 5600 J/cm.

As the grain boundary corrosion test, basically the general practice is to use the sulfuric acid-copper sulfate test (G0575) (Strauss test) defined by the JIS. This test is suitable for a SUS304 or other high chromium stainless steel. However, the corrosiveness is too harsh for stainless steel with a low chromium content in the steel (12% or so low chromium stainless steel), so the test was run by a method of evaluation suitable for low chromium stainless steel. That is, an immersion test was performed in a solution with a sulfuric acid concentration reduced to 0.5% (boiling) over 24 hours (improved Strauss test). Except for reducing the sulfuric acid concentration, the test was performed based on the JIS. The metal structure of the cross-section was observed to judge any occurrence of grain boundary corrosion. The weld heat affected zones were examined and no occurrence of grain boundary corrosion was shown by "G" (good) while occurrence was shown by "P" (poor). Further, no preferential corrosion at all at the heat affected zones most adjoining the weld zones was shown by "VG" (very good), partial occurrence among multiple observed locations was shown by "G" (good), while occurrence of preferential corrosion at all of the multiple observed locations was shown by "P" (poor). Note that seven locations were observed.

Figure 3:
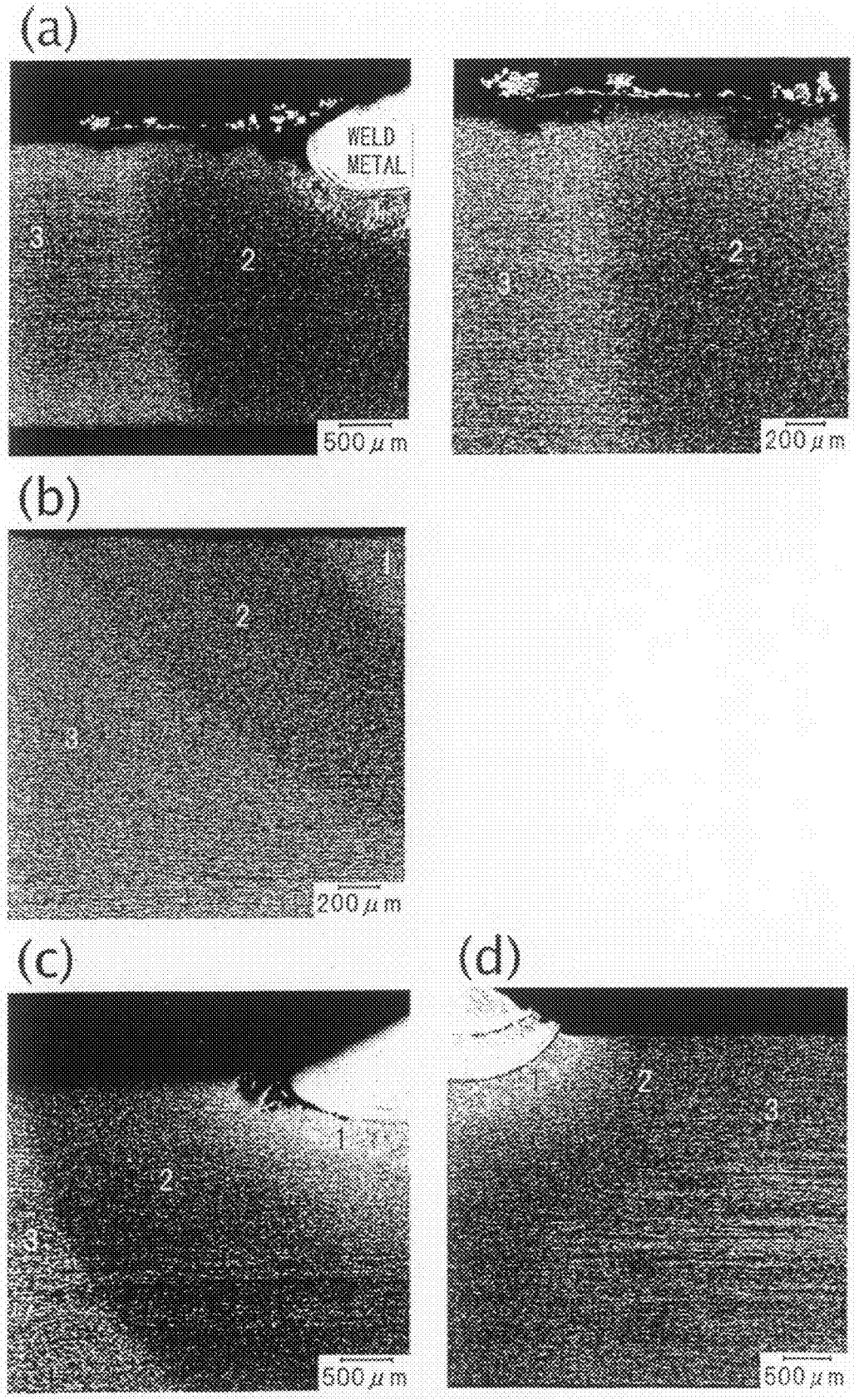
FIG. 3 gives view showing the cross-sectional metal structure of a weld heat affected zone after an improved Strauss test, wherein a) shows the cross-sectional structure of an MIG weld heat affected zone of Comparative Steel No. 21 (no Ti added), b) shows the cross-sectional structure of a TIG weld heat affected zone of Invention Steel No. 1, c) shows the cross-sectional structure of an MIG weld heat affected zone of Invention Steel No. 1, and d) shows the cross-sectional structure of an MIG weld heat affected zone of Invention Steel No. 11. (Note that, in FIGS. 3, 1, 2, and 3 show the weld heat affected zones 1, 2, and 3.)

FIG. 3 is a view showing the cross-sectional metal structures of weld heat affected zones after an improved Strauss test, wherein in a) to d) show, respectively, a) the cross-sectional structure of an MIG weld heat affected zone of the Comparative Steel Material No. 21 (no Ti added), b) the cross-sectional structure of a TIG weld heat affected zone of the Invention Steel Material No. 1, c) the cross-sectional structure of an MIG weld heat affected zone of the Invention Steel Material No. 1, and d) the cross-sectional structure of an MIG weld heat affected zone of the Invention Steel Material No. 11.

A weld zone is formed with not only a built up weld metal part, but also three types of different heat affected zones: the heat affected zone −1 adjoining the weld metal and the adjoining heat affected zone −2 and heat affected zone −3. 1 and 2 are formed with martensite and have metal structures different from the matrix material. The heat affected zone −3 is affected by the heat of the welding, but is not formed with martensite. In FIG. 3*a*), all locations of the heat affected zones 1 to 3 several hundred μm or so from the surface suffer from corrosion mainly comprised of grain boundary corrosion. The corroded parts are the black contrast parts near the surface. Further, the white deposits above them show the precipitated copper and correspond to occurrence of corrosion. The right figure is an enlarged view of the surface part of the left figure. In FIG. 3*b*), no corrosion occurred at all.

Note that in the examples, the TIG welding is performed by filler-free welding, so unlike with MIG welding, there are no weld metal zones. Therefore, there are no heat affected zones at the interfaces with the weld metal zones, so preferential corrosion also hardly occurs. In FIG. 3*c*), the heat affected zones 2 and 3 did not suffer from any corrosion, but the heat affected zone −1 adjoining the weld metal was observed to have wedge-shaped corrosion along the fusion lines. In FIG. 3*d*), the heat affected zone did not suffer from any corrosion at all.

The impact characteristics were evaluated by a Charpy test. JIS-based test pieces of JIS No. 4 shapes and 2 mmV notch subsizes (thickness: 4 mm) were taken from the MIG weld zones and tested by impact tests at 20° C. V-notches were made in the BOND parts where the weld metal and matrix part become ½ each. An impact value of 30 J/cm$^2$ or more was shown as "G" (good), while one of less than 30 J/cm$^2$ was shown as "P" (poor).

TABLE 1

| | Steel material No. | C | Si | Mn | P | S | Cr | Ni | Ti | Cu | N | Nb | Al | Mo | V | Ti/(C + N) | γp (%) | Ti · N | Ac4 (° C.) |
|---|---|---|---|---|---|---|---|---|---|---|---|---|---|---|---|---|---|---|---|
| Inv. | 1 | 0.018 | 0.45 | 1.72 | 0.030 | 0.0114 | 11.21 | 0.91 | 0.240 | | 0.013 | | 0.013 | | | 7.69 | 89.2 | 0.003 | 1155 |
| steel | 2 | 0.019 | 0.49 | 1.88 | 0.030 | 0.0110 | 11.22 | 0.94 | 0.251 | | 0.011 | 0.048 | 0.014 | | | 8.37 | 87.0 | 0.003 | 1125 |
| | 3 | 0.019 | 0.45 | 1.85 | 0.030 | 0.0112 | 11.21 | 0.94 | 0.231 | | 0.010 | 0.142 | 0.014 | | | 7.97 | 83.4 | 0.002 | 1110 |
| | 4 | 0.019 | 0.49 | 1.79 | 0.030 | 0.0111 | 11.18 | 0.94 | 0.247 | 0.40 | 0.010 | 0.141 | 0.014 | | | 8.52 | 85.8 | 0.002 | 1150 |
| | 5 | 0.019 | 0.50 | 1.79 | 0.032 | 0.0113 | 11.11 | 0.95 | 0.267 | 0.29 | 0.010 | | 0.018 | | | 9.21 | 91.1 | 0.003 | 1158 |
| | 6 | 0.018 | 0.50 | 1.78 | 0.032 | 0.0114 | 11.10 | 0.95 | 0.267 | 0.48 | 0.011 | | 0.018 | | | 9.21 | 92.9 | 0.003 | 1174 |
| | 7 | 0.019 | 0.50 | 1.77 | 0.032 | 0.0113 | 11.01 | 0.94 | 0.262 | 0.92 | 0.010 | | 0.017 | | | 9.03 | 97.9 | 0.003 | 1210 |
| | 8 | 0.018 | 0.50 | 1.76 | 0.032 | 0.0111 | 11.63 | 0.94 | 0.259 | 0.91 | 0.011 | | 0.016 | | | 8.93 | 90.8 | 0.003 | 1148 |
| | 9 | 0.006 | 0.50 | 1.79 | 0.030 | 0.0107 | 11.13 | 0.90 | 0.150 | | 0.006 | | 0.011 | | | 12.50 | 85.9 | 0.001 | 1113 |
| | 10 | 0.006 | 0.50 | 1.78 | 0.030 | 0.0112 | 11.05 | 0.90 | 0.146 | 0.51 | 0.006 | | 0.010 | | | 12.27 | 91.5 | 0.001 | 1158 |
| | 11 | 0.021 | 0.50 | 1.76 | 0.030 | 0.0107 | 12.19 | 0.89 | 0.220 | 0.50 | 0.011 | | 0.010 | | | 6.88 | 83.0 | 0.002 | 1114 |
| | 12 | 0.020 | 0.50 | 1.56 | 0.030 | 0.0113 | 11.09 | 0.91 | 0.254 | 0.30 | 0.010 | 0.049 | 0.014 | | | 8.47 | 87.9 | 0.003 | 1145 |
| | 13 | 0.020 | 0.30 | 1.83 | 0.031 | 0.0114 | 11.89 | 0.90 | 0.240 | | 0.012 | | 0.011 | | | 7.50 | 84.0 | 0.003 | 1080 |
| | 14 | 0.020 | 0.50 | 1.81 | 0.030 | 0.0113 | 11.99 | 0.92 | 0.249 | 0.51 | 0.011 | | 0.012 | | | 8.03 | 84.5 | 0.003 | 1116 |
| | 15 | 0.020 | 0.50 | 1.79 | 0.030 | 0.0111 | 11.95 | 0.90 | 0.251 | 0.29 | 0.010 | | 0.011 | | | 8.37 | 81.9 | 0.003 | 1100 |
| | 16 | 0.006 | 0.50 | 1.78 | 0.030 | 0.0112 | 11.98 | 0.92 | 0.149 | 0.49 | 0.006 | | 0.014 | | | 12.42 | 80.8 | 0.001 | 1123 |
| | 17 | 0.006 | 0.50 | 1.76 | 0.030 | 0.0112 | 11.99 | 0.90 | 0.151 | 0.32 | 0.010 | | 0.013 | | | 9.44 | 80.4 | 0.002 | 1107 |
| | 18 | 0.020 | 0.20 | 1.81 | 0.030 | 0.0111 | 12.87 | 0.91 | 0.151 | 0.50 | 0.010 | | 0.013 | | | 5.03 | 81.8 | 0.002 | 1080 |
| | 19 | 0.018 | 0.50 | 1.95 | 0.030 | 0.0114 | 11.51 | 0.92 | 0.231 | | 0.011 | | 0.012 | 0.3 | | 7.97 | 82.9 | 0.003 | 1058 |
| | 20 | 0.020 | 0.40 | 1.85 | 0.030 | 0.0113 | 11.21 | 0.91 | 0.251 | | 0.010 | | 0.014 | | 0.10 | 8.37 | 87.1 | 0.003 | 1058 |

TABLE 1-continued

| | Steel material No. | C | Si | Mn | P | S | Cr | Ni | Ti | Cu | N | Nb | Al | Mo | V | Ti/ (C + N) | γp (%) | Ti · N | Ac4 (° C.) |
|---|---|---|---|---|---|---|---|---|---|---|---|---|---|---|---|---|---|---|---|
| Comp. steel | 21 | 0.021 | 0.15 | 1.86 | 0.025 | 0.0011 | 10.97 | 0.38 | 0.006 | | 0.015 | | 0.014 | | | 0.16 | 97.9 | 0.000 | 1145 |
| | 22 | 0.020 | 0.50 | 1.81 | 0.030 | 0.0112 | 11.01 | 0.90 | 0.249 | | 0.020 | | 0.012 | | | 6.23 | 95.0 | 0.005 | 1074 |
| | 23 | 0.020 | 0.50 | 1.79 | 0.030 | 0.0111 | 11.09 | 0.90 | 0.400 | 0.49 | 0.020 | | 0.015 | | | 10.00 | 90.8 | 0.008 | 1200 |
| | 24 | 0.020 | 0.50 | 1.77 | 0.030 | 0.0107 | 13.01 | 0.94 | 0.248 | | 0.015 | | 0.014 | | | 7.09 | 70.2 | 0.004 | 970 |
| | 25 | 0.020 | 0.50 | 1.77 | 0.030 | 0.0107 | 15.50 | 0.91 | 0.251 | | 0.014 | | 0.014 | | | 7.38 | 40.3 | 0.004 | — |
| | 26 | 0.020 | 0.50 | 1.79 | 0.030 | 0.0103 | 9.03 | 0.90 | 0.247 | | 0.012 | | 0.016 | | | 7.72 | 113.7 | 0.003 | 1242 |

γP(%) = 420[C] + 470[N] + 23[Ni] + 9[Cu] + 7[Mn] − 11.5[Cr] − 11.5[Si] − 12[Mo] − 23[V] − 47[Nb] − 49[Ti] − 52[Al] + 189

__: shows outside range of present invention

TABLE 2

| | Case study no. | Steel Material No. | Hot rolling heat temp. | Cal. δ amount | Manufacturability: Edge cracking | Manufacturability: Surface defects | Material quality (tensile test): 0.2% yield strength | Material quality (tensile test): Elongation | Sulfuric acid immersion test Sulfuric acid resistance |
|---|---|---|---|---|---|---|---|---|---|
| Inv. ex. | 1 | 1 | 1150° C. | 0% | G | G | G | G | G |
| | 2 | 2 | 1250° C. | 57% | G | G | G | G | G |
| | 3 | 3 | 1250° C. | 65% | G | G | G | G | G |
| | 4 | 4 | 1150° C. | 0% | G | G | G | G | VG |
| | 5 | 5 | 1150° C. | 0% | G | G | G | G | VG |
| | 6 | 6 | 1150° C. | 0% | G | G | G | G | VG |
| | 7 | 7 | 1150° C. | 0% | G | G | G | G | VG |
| | 8 | 8 | 1240° C. | 54% | G | G | G | G | VG |
| | 9 | 9 | 1250° C. | 97% | G | G | G | G | G |
| | 10 | 10 | 1150° C. | 0% | G | G | G | G | VG |
| | 11 | 11 | 1215° C. | 55% | G | G | G | G | VG |
| | 12 | 12 | 1150° C. | 0% | G | G | G | G | VG |
| | 13 | 13 | 1200° C. | 70% | G | G | G | G | VG |
| | 14 | 14 | 1215° C. | 55% | G | G | G | G | VG |
| | 15 | 15 | 1200° C. | 55% | G | G | G | G | VG |
| | 16 | 16 | 1215° C. | 58% | G | G | G | G | VG |
| | 17 | 17 | 1200° C. | 58% | G | G | G | G | VG |
| | 18 | 18 | 1200° C. | 61% | G | G | G | G | VG |
| | 19 | 19 | 1175° C. | 62% | G | G | G | G | VG |
| | 20 | 20 | 1200° C. | 71% | G | G | G | G | G |
| Comp. ex. | 21 | 21 | 1220° C. | 53% | G | G | G | G | G |
| | 22 | 22 | 1190° C. | 65% | G | P | G | G | G |
| | 23 | 23 | 1190° C. | 0% | G | P | G | G | VG |
| | 24 | 24 | 1170° C. | 75% | G | G | G | G | VG |
| | 25 | 25 | 1200° C. | 100% | G | G | G | G | VG |
| | 26 | 26 | 1200° C. | 0% | G | G | G | G | P |
| | 27 | 11 | 1150° C. | 20% | P | G | G | G | VG |

| | Case study no. | Characteristics of TIG weld heat affected zone: Improved Strauss test: Grain boundary corrosion | Characteristics of TIG weld heat affected zone: Improved Strauss test: Preferential corrosion | Characteristics of MIG weld heat affected zone: Improved Strauss test: Grain boundary corrosion | Characteristics of MIG weld heat affected zone: Improved Strauss test: Preferential corrosion | Charpy test Impact resistance |
|---|---|---|---|---|---|---|
| Inv. ex. | 1 | G | VG | G | G | G |
| | 2 | G | VG | G | G | G |
| | 3 | G | VG | G | G | G |
| | 4 | G | VG | G | G | G |
| | 5 | G | VG | G | G | G |
| | 6 | G | VG | G | G | G |
| | 7 | G | VG | G | G | G |
| | 8 | G | VG | G | VG | G |
| | 9 | G | VG | G | G | G |
| | 10 | G | VG | G | G | G |
| | 11 | G | VG | G | VG | G |
| | 12 | G | VG | G | G | G |
| | 13 | G | VG | G | VG | G |

TABLE 2-continued

| | | | | | | |
|---|---|---|---|---|---|---|
| | 14 | G | VG | G | VG | G |
| | 15 | G | VG | G | VG | G |
| | 16 | G | VG | G | VG | G |
| | 17 | G | VG | G | VG | G |
| | 18 | G | VG | G | VG | G |
| | 19 | G | VG | G | VG | G |
| | 20 | G | VG | G | VG | G |
| Comp. | 21 | P | VG | P | P | G |
| ex. | 22 | G | VG | G | G | G |
| | 23 | G | VG | G | G | G |
| | 24 | G | VG | G | VG | P |
| | 25 | G | VG | G | VG | P |
| | 26 | P | VG | P | P | G |
| | 27 | G | VG | G | VG | G |

Example 2

Table 3 and Table 4 show invention examples and comparative examples relating to the second pending issue.

Table 3 shows the steel ingredients of the invention steels (Steel Material Nos. 27 to 35) by mass %. The vacuum melting method was used to melt cast slabs of the ingredients shown in Table 3 into 40 kg or 35 kg flat ingots. These steels were touched up on their surfaces, then the ingots were heated at 1150° C. for 1 hour and processed by hot roughing comprised of multiple passes and the following final hot rolling. The end temperature of the hot rolling was 800° C. to 900° C. The hot rolled plates were air cooled, then soaked at a coiling temperature of 500° C. for 1 hour, then air-cooled and coiled up for a simulated heat treatment to obtain hot rolled plate of a plate thickness of 4 mm. Next, to determine the annealing temperature of the hot rolled plate, various ingredients of hot rolled plates were soaked at 575° C. to 850° C. for 5 to 50 hours, then, simulating the cooling process of batch heat treatment, were cooled by controlled cooling by 20° C./h and were taken out from the furnace at 100° C. or less.

Figure 4:
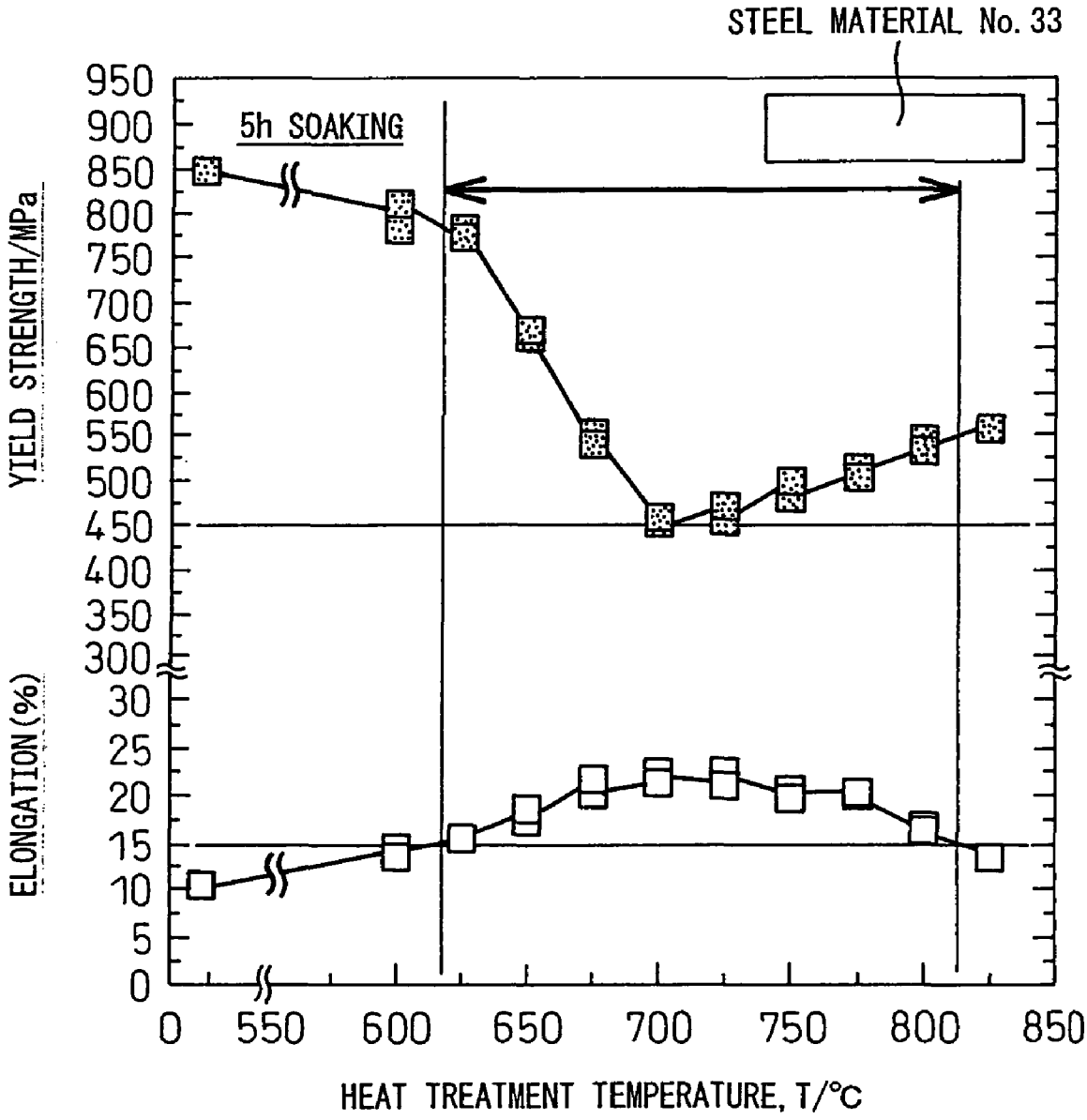
FIG. 4 is a view showing an example of the relationship between the annealing conditions and strength and ductility.

FIG. 4 is an example showing the relationship between the heat treatment conditions and the strength and ductility. When soaking Steel Material No. 33 for 5 hours, it features high strength and low elongation in the hot rolled state, but heat treatment may be performed for softening it. In this example, there are conditions in a broad temperature range of 675° C. to 800° C. where the yield strength is 450 MPa or more and the elongation is 15% or more.

Finally, shot blasting and pickling were used for descaling to thereby produce hot rolled annealed plate.

Table 4 show the heat treatment conditions of the invention examples and comparative examples and the results of evaluation of the various properties. Case Study Nos. 28 to 41 show invention examples, while Case Study Nos. 42 to 50 show comparative examples. In the case of a metal structure corresponding to claim 4 of the present invention, a high strength, low chromium stainless steel having an elongation of 15% or more or 20% or more and a yield strength of 450 MPa or more for a superior strength-ductility balance is obtained.

For example, Case Study No. 36 has a B value of 0.36, a 0.2% yield strength of 538 MPa, and an elongation of 21.5%.

These steels are superior in grain boundary corrosion resistance of the multipass weld heat affected zones and preferential corrosion resistance near the weld zone fusion lines.

Case Study Nos. 42 to 46, 49, and 50 of the comparative examples had heat treatment conditions of a low temperature or short time, that is, not suitable, so the metal structures were outside the range of the present invention, therefore the elongations were less than 15% and the strength-ductility balances were poor. Case Study Nos. 47 and 48 of the comparative examples had heat treatments of long times, that is, not suitable, so the metal structures were outside the range of the present invention, therefore the yield strengths were less than 450 MPa and the strength-ductility balances were poor.

The evaluation tests were run by the following methods. The procedure was based on Example 1 other than the following.

The metal structure was judged by evaluation by the spread B of half width of the Cu—Kα1 {110} diffraction line in X-ray diffraction. A B value of 0.1 to 1.0 is shown as "G (good)", while one of less than 0.1 or over 1.0 is shown as "P (poor)".

The 0.2% yield strength and elongation were measured by methods similar to Example 1, but were evaluated as follows: A 0.2% yield strength of 450 MPa or more was shown as "G (good)", while one of less than 450 MPa was shown as "P (poor)". In particular, the case of a 0.2% yield strength of 500 MPa or more was shown as "VG (very good)". Further, an elongation of 15% or more was shown as "G (good)", while one of less than 15% was shown as "P". In particular, the case of an elongation of 20% or more was shown as "VG (very good)".

TABLE 3

| | Steel material no. | C | Si | Mn | P | S | Cr | Ni | Ti | Cu | N | Nb | Al | Mo | V | Ti/(C + N) | γP (%) | Ti · N |
|---|---|---|---|---|---|---|---|---|---|---|---|---|---|---|---|---|---|---|
| Inv. | 27 | 0.018 | 0.52 | 1.72 | 0.030 | 0.0114 | 11.21 | 1.20 | 0.250 | | 0.013 | | 0.013 | | | 8.01 | 94.6 | 0.003 |
| steel | 28 | 0.019 | 0.52 | 1.79 | 0.030 | 0.0112 | 11.21 | 1.12 | 0.248 | | 0.010 | 0.051 | 0.014 | | | 8.55 | 89.8 | 0.002 |
| | 29 | 0.019 | 0.51 | 1.80 | 0.029 | 0.008 | 11.03 | 0.71 | 0.253 | 0.50 | 0.011 | | 0.019 | | | 8.55 | 89.2 | 0.003 |
| | 30 | 0.019 | 0.52 | 1.82 | 0.029 | 0.009 | 10.93 | 1.32 | 0.257 | 0.50 | 0.010 | | 0.017 | | | 8.86 | 104.1 | 0.003 |
| | 31 | 0.022 | 0.50 | 1.78 | 0.028 | 0.0104 | 11.04 | 0.80 | 0.237 | 0.50 | 0.009 | 0.051 | 0.014 | | | 7.65 | 90.4 | 0.002 |

TABLE 3-continued

| Steel material no. | C | Si | Mn | P | S | Cr | Ni | Ti | Cu | N | Nb | Al | Mo | V | Ti/(C + N) | γP (%) | Ti · N |
|---|---|---|---|---|---|---|---|---|---|---|---|---|---|---|---|---|---|
| 32 | 0.022 | 0.50 | 1.77 | 0.028 | 0.0107 | 11.01 | 0.81 | 0.240 | 0.49 | 0.009 | 0.101 | 0.017 | | | 7.69 | 88.2 | 0.002 |
| 33 | 0.022 | 0.50 | 1.78 | 0.028 | 0.0106 | 11.04 | 0.81 | 0.234 | 0.50 | 0.009 | 0.155 | 0.018 | | | 7.55 | 85.7 | 0.002 |
| 34 | 0.016 | 0.50 | 1.82 | 0.03 | 0.0114 | 11.51 | 1.10 | 0.249 | | 0.010 | | 0.012 | 0.3 | | 8.89 | 84.8 | 0.002 |
| 35 | 0.020 | 0.40 | 1.85 | 0.03 | 0.0113 | 11.81 | 1.15 | 0.237 | | 0.010 | | 0.014 | | 0.10 | 7.90 | 86.4 | 0.002 |

γP(%) = 420[C] + 470[N] + 23[Ni] + 9[Cu] + 7[Mn] − 11.5[Cr] − 11.5[Si] − 12[Mo] − 23[V] − 47[Nb] − 49[Ti] − 52[Al] + 189

TABLE 4

| | Case study no. | Steel type No. | Heat treatment conditions Temp. (° C.) | Heat treatment conditions Hour (h) | Metal structure Spread of half-width of {110} diffraction line | Material quality (tensile test) 0.2% yield strength | Material quality (tensile test) Elongation | Sulfuric acid immersion test Sulfuric acid resistance |
|---|---|---|---|---|---|---|---|---|
| Inv. ex. | 28 | 27 | 650 | 25 | G | VG | G | G |
| | 29 | 28 | 650 | 20 | G | VG | G | G |
| | 30 | 29 | 650 | 5 | G | VG | G | VG |
| | 31 | 30 | 675 | 25 | G | VG | G | VG |
| | 32 | 31 | 625 | 15 | G | VG | VG | VG |
| | 33 | 31 | 750 | 5 | G | VG | VG | VG |
| | 34 | 32 | 650 | 15 | G | VG | VG | VG |
| | 35 | 32 | 750 | 5 | G | VG | VG | VG |
| | 36 | 32 | 675 | 5 | G | VG | VG | VG |
| | 37 | 33 | 675 | 10 | G | VG | VG | VG |
| | 38 | 33 | 750 | 5 | G | G | VG | VG |
| | 39 | 33 | 650 | 10 | G | VG | G | VG |
| | 40 | 34 | 650 | 10 | G | VG | G | VG |
| | 41 | 35 | 650 | 15 | G | VG | G | VG |
| Comp. ex. | 42 | 27 | 650 | 1 | P | VG | P | G |
| | 43 | 28 | 800 | 1 | P | VG | P | G |
| | 44 | 29 | 575 | 25 | P | VG | P | VG |
| | 45 | 30 | 850 | 5 | P | VG | P | VG |
| | 46 | 31 | 575 | 25 | P | VG | P | VG |
| | 47 | 32 | 660 | 50 | P | P | VG | VG |
| | 48 | 33 | 675 | 50 | P | P | VG | VG |
| | 49 | 34 | 850 | 5 | P | VG | P | VG |
| | 50 | 35 | 575 | 25 | P | VG | P | VG |

| | Case study no. | Characteristics of TIG weld heat affected zone: Improved Strauss test: Grain boundary corrosion | Characteristics of TIG weld heat affected zone: Improved Strauss test: Preferential corrosion | Characteristics of MIG weld heat affected zone: Improved Strauss test: Grain boundary corrosion | Characteristics of MIG weld heat affected zone: Improved Strauss test: Preferential corrosion | Characteristics of MIG weld heat affected zone: Charpy test: Impact resistance | Surface defects |
|---|---|---|---|---|---|---|---|
| Inv. ex. | 28 | G | VG | G | G | G | G |
| | 29 | G | VG | G | G | G | G |
| | 30 | G | VG | G | VG | G | G |
| | 31 | G | VG | G | VG | G | G |
| | 32 | G | VG | G | VG | G | G |
| | 33 | G | VG | G | VG | G | G |
| | 34 | G | VG | G | VG | G | G |
| | 35 | G | VG | G | VG | G | G |
| | 36 | G | VG | G | VG | G | G |
| | 37 | G | VG | G | VG | G | G |
| | 38 | G | VG | G | VG | G | G |
| | 39 | G | VG | G | VG | G | G |
| | 40 | G | VG | G | G | G | G |
| | 41 | G | VG | G | VG | G | G |

TABLE 4-continued

| | | | | | | | |
|---|---|---|---|---|---|---|---|
| Comp. ex. | 42 | G | VG | G | G | P | G |
| | 43 | G | VG | G | G | P | G |
| | 44 | G | VG | G | VG | P | G |
| | 45 | G | VG | G | VG | P | G |
| | 46 | G | VG | G | VG | P | G |
| | 47 | G | VG | G | VG | G | G |
| | 48 | G | VG | G | VG | G | G |
| | 49 | G | VG | G | G | G | G |
| | 50 | G | VG | G | VG | G | G |

INDUSTRIAL APPLICABILITY

The present invention can provide low chromium stainless steel which does not contain more than the necessary amount of expensive elements, can be used as structural steel even in harsh corrosive environments, is free from preferential corrosion at zones adjoining welds near fusion lines, and is superior in grain boundary corrosion resistance of multipass weld zones and can provide a high strength material in accordance with need, so is an invention with an extremely high value in industry.

The invention claimed is:

1. Low chromium stainless steel superior in grain boundary corrosion resistance of multipass weld heat affected zones and preferential corrosion resistance near weld zone fusion lines characterized by containing, by mass %, C: 0.03% or less, N: 0.004 to 0.02%, Si: 0.2 to 1%, Mn: over 1.5 to 2.5%, P: 0.04% or less, S: 0.03% or less, Cr: 10 to 15%, Ni: 0.2 to 3.0%, and Al: 0.005 to 0.1%, further containing Ti: 4×(C %+N %) to 0.35%, and having a balance of Fe and unavoidable impurities, and having contents of the elements satisfying the following formula (A) and formula (B):

$$\gamma p(\%)=420\times C\%+470\times Ni\%+23\times Ni\%+9\times Cu\%+7\times Mn\%-11.5\times Cr\%-11.5\times Si\%-12\times Mo\%-23\times V\%-47\times Nb\%-49\times Ti\%-52\times Al\%+189\geqq 80 \quad (A)$$

$$Ti\%\times N\%<0.004 \quad (B).$$

2. Low chromium stainless steel superior in grain boundary corrosion resistance of multipass weld heat affected zones and preferential corrosion resistance near weld zone fusion lines as set forth in claim 1, characterized by further containing, by mass %, one or both of Mo: 0.05 to 3% and Cu: 0.05 to 3%.

3. Low chromium stainless steel superior in grain boundary corrosion resistance of multipass weld heat affected zones and preferential corrosion resistance near weld zone fusion lines as set forth in claim 1 or 2, characterized by further containing, by mass %, one or both of Nb: 0.01 to 0.5% and V: 0.01 to 0.5%.

4. Low chromium stainless steel superior in grain boundary corrosion resistance of multipass weld heat affected zones and preferential corrosion resistance near weld zone fusion lines comprising the low chromium stainless steel as set forth in claim 1 or 2, characterized in that a metal structure is a two-phase structure of a ferritic phase and martensitic phase and in that a spread B of half width defined by the following formula (C) of a Kα{110} diffraction line in X-ray diffraction is 0.1 to 1.0

$$B=(W-Wo)/Wo \quad (C)$$

Wo: Half width without internal strain (deg)

W: Half width (deg).

5. Low chromium stainless steel superior in grain boundary corrosion resistance of multipass weld heat affected zones and preferential corrosion resistance near weld zone fusion lines comprising the low chromium stainless steel as set forth in claim 3, characterized in that a metal structure is a two-phase structure of a ferritic phase and a martensitic phase and in that a spread B of half width defined by the following formula (C) of a Kα{110} diffraction line in X-ray diffraction is 0.1 to 1.0.

$$B=(W-Wo)/Wo \quad (C)$$

Wo: Half width without internal strain (deg)

W: Half width (deg).

* * * * *